US010557355B2

(12) United States Patent
Yamamoto

(10) Patent No.: US 10,557,355 B2
(45) Date of Patent: Feb. 11, 2020

(54) TURBINE ROTOR ASSEMBLY, TURBINE, AND ROTOR BLADE

(71) Applicant: MITSUBISHI HITACHI POWER SYSTEMS, LTD., Kanagawa (JP)

(72) Inventor: Yuki Yamamoto, Kanagawa (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 213 days.

(21) Appl. No.: 15/506,896

(22) PCT Filed: Nov. 11, 2015

(86) PCT No.: PCT/JP2015/081793

§ 371 (c)(1),
(2) Date: Feb. 27, 2017

(87) PCT Pub. No.: WO2016/076374

PCT Pub. Date: May 19, 2016

(65) Prior Publication Data

US 2017/0284209 A1 Oct. 5, 2017

(30) Foreign Application Priority Data

Nov. 12, 2014 (JP) ..... 2014-229788

(51) Int. Cl.
*F01D 5/30* (2006.01)
*F01D 5/14* (2006.01)
(Continued)

(52) U.S. Cl.
CPC ..... *F01D 5/3007* (2013.01); *F01D 5/141* (2013.01); *F01D 5/16* (2013.01); *F01D 5/30* (2013.01);
(Continued)

(58) Field of Classification Search
CPC ..... F01D 5/3007; F01D 5/3038; F01D 5/16; F01D 5/141; F01D 5/30; F01D 5/022; F05D 2220/31; F05D 2240/30; F05D 2240/80
See application file for complete search history.

(56) References Cited

U.S. PATENT DOCUMENTS 2,295,012 A * 9/1942 Semar ..... F01D 5/3038 416/201 R
2,809,801 A * 10/1957 Curry ..... F01D 5/3038 416/135
(Continued)

FOREIGN PATENT DOCUMENTS

CN 2653132 11/2004
GB 359350 10/1931
(Continued)

OTHER PUBLICATIONS

Korean Notification of Reason for Refusal dated Mar. 9, 2018 in corresponding Korean Patent Application No. 10-2017-7008302 with Machine Translation.
(Continued)

*Primary Examiner* — Nathan C Zollinger
(74) *Attorney, Agent, or Firm* — Wenderoth, Lind & Ponack, L.L.P.

(57) ABSTRACT

A turbine rotor assembly includes a rotor shaft and rotor blades. The rotor shaft includes two protrusions, two bearing surfaces, two first facing surfaces, and two second facing surfaces positioned on the outer side of the first facing surfaces. The blade root section of each of the rotor blades includes two contact surfaces which are contactable with the two bearing surfaces in the radial direction of the rotor shaft, respectively, two first side surfaces each facing a corresponding one of the two first facing surfaces, two second side surfaces each facing a corresponding one of the two
(Continued)

second facing surfaces, and two flange sections which are each positioned adjacent to the outer circumferential surface of a corresponding one of the two protrusions.

14 Claims, 4 Drawing Sheets

(51) Int. Cl.
*F01D 5/16* (2006.01)
*F01D 5/02* (2006.01)

(52) U.S. Cl.
CPC ..... *F01D 5/3038* (2013.01); *F01D 5/022* (2013.01); *F05D 2220/31* (2013.01); *F05D 2240/30* (2013.01); *F05D 2240/80* (2013.01)

(56) References Cited

U.S. PATENT DOCUMENTS

| | | | | | |
|---|---|---|---|---|---|
| 5,044,886 | A * | 9/1991 | Stenneler | F01D 5/3038 | 416/193 A |
| 5,271,718 | A * | 12/1993 | Mitchell, Jr. | F01D 5/22 | 416/193 A |
| 7,094,035 | B2 * | 8/2006 | Kramer | F01D 5/147 | 416/241 R |
| 9,057,278 | B2 * | 6/2015 | Howes | F01D 5/3038 | |
| 2011/0008171 | A1 * | 1/2011 | Tsumura | F01D 5/3038 | 416/218 |
| 2014/0182293 | A1 * | 7/2014 | Aiello | F04D 29/322 | 60/726 |

FOREIGN PATENT DOCUMENTS

| | | | | |
|---|---|---|---|---|
| GB | 2265671 A | * | 10/1993 | F01D 5/3038 |
| JP | 54-145806 | | 10/1979 | |
| JP | 63-168201 | | 11/1988 | |
| JP | 1-131801 | | 9/1989 | |
| JP | 7-63004 | | 3/1995 | |
| JP | 10-184307 | | 7/1998 | |
| JP | 10-299406 | | 11/1998 | |
| JP | 2002-250202 | | 9/2002 | |
| JP | 2012-067746 | | 4/2012 | |
| JP | 2012-127338 | | 7/2012 | |
| JP | 2013-139769 | | 7/2013 | |
| JP | 2014-40829 | | 3/2014 | |
| JP | 2014-092161 | | 5/2014 | |

OTHER PUBLICATIONS

International Preliminary Report on Patentability and Written Opinion of the International Searching Authority dated May 26, 2017 in corresponding International (PCT) Application No. PCT/JP2015/081793, with English translation.

Office Action dated Sep. 22, 2017 in corresponding Chinese Application No. 201580043835.8, with English translation.

International Search Report dated Feb. 16, 2016 in International (PCT) Application No. PCT/JP2015/081793.

Office Action dated Jul. 26, 2019 in Indian Patent Application No. 201717010122.

* cited by examiner

TURBINE ROTOR ASSEMBLY, TURBINE, AND ROTOR BLADE

TECHNICAL FIELD

The present disclosure related to a turbine rotor assembly, a turbine, and a rotor blade.

BACKGROUND

An axial turbine used for power generation includes, for example: a plurality of stator cascades fixed to a chamber; and a plurality of rotor cascades fixed to a rotor shaft. The stator cascade includes a plurality of turbine stator blades. The rotor cascade includes a plurality of turbine rotor blades.

Some turbine rotor blades include a T-shaped blade root section. The blade root section is fit in the blade groove formed on the rotor shaft, and thus the turbine rotor blade is fixed to the rotor shaft. The blade groove also has a T lateral cross-sectional shape corresponding to the shape of the blade root section. While the turbine is operating, centrifugal force acts on the turbine rotor blade. As a result, a contact surface of the blade root section, facing outward in a radial direction of the rotor shaft, contacts a bearing surface of the rotor shaft facing inward in the radial direction of the rotor shaft.

Japanese Patent Application Publication No. H7-63004 discloses the turbine rotor blade of this type. The turbine rotor blade has a step formed at a neck portion corresponding to a longitudinal bar of the T shape of the blade root section. The step is separated from a wall surface of the blade groove in a state where a rotor disk, forming a part of the rotor shaft, is stationary. The step is configured to contact the wall surface of the blade groove when the amplitude of the vibration of the turbine rotor blade increases while the turbine is operating. In this configuration, the frequency of the vibration of the blade can be changed by changing a boundary condition of the vibration of the turbine rotor blade. As a result, resonation with a certain exciting frequency can be prevented, whereby the reliability of the turbine rotor blade can be largely improved.

In the turbine rotor blade disclosed in Japanese Patent Application Publication No. H7-63004, the neck portion of the blade root section has one end extending outward, in the radial direction of the rotor shaft, from the outer circumferential surface of the rotor shaft. This portion has a length, in the axial direction of the rotor shaft, larger than a width of the neck portion in the blade groove, and serves as a platform section supporting the blade profile section.

Technical Problem

Recently, the turbines have been required to have a larger number of stages, that is, a larger number of stator cascades and rotor cascades without having a larger size, or to be downsized with the number of stages maintained. Such requirements may be satisfied by setting the length of each stage in the axial direction of the rotor shaft shorter.

However, when the turbine rotor blade and the rotor disk disclosed in Japanese Patent Application Publication No. H7-63004 are used, the length of the stage in the axial direction of the rotor shaft is difficult to reduce. This is because the step is provided on the neck portion of the blade root section (see FIGS. 1 and 7 in Japanese Patent Application Publication No. H7-63004), and thus if the blade groove has the T lateral cross-sectional shape, a sufficient contact area between the bearing surface of the rotor shaft and the contact surface of the blade root section can only be achieved with the contact surface of the blade root section extended in the axial direction of the rotor shaft for about (W1−W) in FIG. 1 in Japanese Patent Application Publication No. H7-63004.

SUMMARY

In view of the above, an object of at least one embodiment of the present invention is to provide a turbine rotor assembly, a turbine, and a rotor blade with which a small interval of rotor cascades can be achieved.

Solution to Problem (1) A turbine rotor assembly according to at least one embodiment of the present invention includes:

- a rotor shaft on which a blade groove extending along a circumferential direction is formed; and
- a plurality of rotor blades each including:
  - a blade section disposed on an outer side of the rotor shaft in a radial direction of the rotor shaft; and
  - a blade root section integrally formed with the blade section and is fit in the blade groove, in which
- the rotor shaft includes:
  - two protrusions which are separated from each other in an axial direction of the rotor shaft and form a part of a wall surface of the blade groove and an opening of the blade groove, the two protrusions each protruding outward from an outer circumferential surface of the rotor shaft in the radial direction of the rotor shaft;
  - two bearing surfaces disposed on an inner side of the outer circumferential surface of the rotor shaft in the radial direction of the rotor shaft to face inward in the radial direction of the rotor shaft, the two bearing surfaces being separated from each other in the axial direction of the rotor shaft and forming a part of the wall surface of the blade groove;
  - two first facing surfaces which face each other in the axial direction of the rotor shaft and form a part of the wall surface of the blade groove, the first facing surfaces being disposed between the bearing surfaces and outer circumferential surfaces of the protrusion in the radial direction of the rotor shaft; and
  - two second facing surfaces disposed between the bearing surfaces and the outer circumferential surfaces of the protrusions in the radial direction of the rotor shaft, on an outer side of the two first facing surfaces, the two second facing surfaces facing each other in the axial direction of the rotor shaft with a gap therebetween larger than a gap between the first facing surfaces and forming a part of the wall surface of the blade groove, and
- the blade root section of each of the rotor blades includes:
  - two contact surfaces which are separated from each other in the axial direction of the rotor shaft, and are contactable with the two bearing surfaces in the radial direction of the rotor shaft, respectively;
  - two first side surfaces each facing a corresponding one of the two first facing surfaces;
  - two second side surfaces each facing a corresponding one of the two second facing surfaces with a gap therebetween that is smaller than a distance between the first facing surface and the first side surface; and
  - two flange sections which are each positioned, when the blade root section of the rotor blade is assembled to the blade groove formed on the rotor shaft, adjacent to the outer circumferential surface of a corresponding one of the two protrusions in the radial direction of the rotor shaft, the flange sections forming a part of a platform section continuing to the blade profile section.

In this configuration, the rotor blade includes the first side surfaces and the second side surfaces. The rotor shaft has a corresponding structure with the first facing surfaces and the second facing surfaces forming a part of the wall surface of the blade groove. The gap between the first facing surfaces is smaller than the gap between the second facing surfaces. A contact area between the contact surfaces of the blade root section and the bearing surfaces of the rotor shaft can be increased in accordance with the difference between the gaps. Thus, the blade root section of the head portion can have a short length in the axial direction of the rotor shaft, whereby a small interval of the rotor cascades can be achieved.

As a result, the medium-pressure turbine using the turbine rotor assembly can have the number of stages increased without having an increased size, or can have a smaller size with the number of stages maintained.

The second facing surface faces the second side surface of the blade root section and covers a part of the blade root section extending outward in the radial direction of the rotor shaft from the outer circumferential surface of the rotor shaft. Thus, an exposed portion is reduced, whereby leakage of working fluid through a gap between adjacent blade root sections can be reduced.

The blade root section is provided with the two flange sections positioned adjacent the outer circumferential surfaces of the two protrusions in the radial direction of the rotor shaft when the blade root section is assembled to the blade groove. The platform section includes the flange sections, and thus a large platform section supporting the blade profile section can be formed.

The platform section has a part disposed on the outer side of the protrusions in the radial direction of the rotor shaft. Therefore, the length of the turbine stage needs not to be set large in accordance with the width of the protrusions (length in the axial direction of the rotor shaft). Alternatively, the platform section (and thus the blade profile section) needs not to be set small, when the length of the turbine stage is the same.

(2) In some embodiments, in the configuration (1), a length, in the axial direction of the rotor shaft, of the blade root section including the contact surface, at a position where the contact surface is formed, is 1.2 times a length of the platform section or less.

In this configuration, with the length W, in the axial direction of the rotor shaft, of the head portion of the blade root section being 1.2 times the length of the platform section or less, the small interval of the rotor cascades 31 can be guaranteed.

(3) In some embodiments, in the configuration (2), the length, in the axial direction of the rotor shaft, of the blade root section including the contact surface, at the position where the contact surface is formed, is not longer than a length of the platform section.

In this configuration with the length, in the axial direction of the rotor shaft, of the blade root section being not larger than the length of the platform section, the small interval of the rotor cascades can be guaranteed more reliably.

(4) In some embodiments, in any one of the configurations (1) to (3), the two protrusions include:

a first protrusion positioned on an upstream side in a flow direction of a working fluid; and a second protrusion positioned on a downstream side, a length of at least the first flange section is shorter than a length between the outer circumferential surface of the rotor shaft and the outer circumferential surface of the first protrusion, in the radial direction of the rotor shaft.

In a configuration where the plurality of rotor blades are arranged along the circumferential direction of the rotor shaft, when there is a gap between the first flange sections in the circumferential direction, the working fluid flows through the gap. Thus, the efficiency of the medium-pressure turbine is degraded. In this regard, when the length of the first flange section on the upstream side in the steam flow direction is shorter than the first protrusion, the gap between the first flange sections can be made smaller, whereby the leakage flow of the working fluid can be reduced.

As a result, the medium-pressure turbine using the turbine rotor assembly can have a higher efficiency.

(5) In some embodiments, in any one of the configurations (1) to (4), the rotor shaft has a drum shape.

Generally, when the rotor shaft has a drum shape, the rotor blade is a reaction blade. When the rotor blade is a reaction blade, the number of stages is likely to be larger than that in a case of an impulse blade. In the configuration described above, the interval of the rotor cascades in the axial direction of the rotor shaft can be made small, and thus the size of the medium-pressure turbine can be prevented from increasing even when there is a large number of stages.

(6) At least one embodiment of the present invention provides a turbine including:

the turbine rotor assembly according to any one of configurations (1) to (5);

a housing enclosing the turbine rotor assembly; and a plurality of stator blades attached to the housing.

In the turbine rotor assembly with any one of the configurations (1) to (5), the blade root section of the head portion can have a short length in the axial direction of the rotor shaft, whereby a small interval of the rotor cascades can be achieved. As a result, the medium-pressure turbine using the turbine rotor assembly can have the number of stages increased without having an increased size, or can have a smaller size with the number of stages maintained.

(7) At least one embodiment of the present invention provides a rotor blade for the turbine rotor assembly with any one the configurations (1) to (5).

(8) A rotor blade according to at least one embodiment of the present invention includes:

a blade root section which has a T shape and is fit in a blade groove with a T-shaped circumferential cross section, the blade groove being perforated toward an inner side from an outer circumferential surface of a rotor shaft;

two first side surfaces each facing a corresponding one of two rotor-shaft radially perforated surfaces which define the blade groove and extend in a radial direction of the rotor shaft;

contact surfaces which are contactable with rotor-shaft outer circumferential surface side perforated surfaces which serve as bearing surfaces, the rotor-shaft outer circumferential surface side perforated surfaces defining the blade groove and extending in an axial direction of the rotor shaft;

two second side surfaces each facing a corresponding one of two rotor-shaft radial direction inner side annular surfaces of protrusions protruding in the rotor-shaft radial direction from an outer circumferential surface of the rotor shaft, the two rotor-shaft radial direction inner side annular surfaces forming a part of a rotor shaft radial wall surface of the blade groove, the two second side surfaces being separated from each other in the axial direction of the rotor shaft with a gap therebetween larger than a gap between the two first side surfaces; and jaw portions forming a platform section of the rotor blade and disposed adjacent to rotor-shaft radial top outer circumferential surfaces of the protrusions, on an outer side in the radial direction of the rotor shaft.

Advantageous Effects

At least one embodiment of the present invention can provide a turbine rotor assembly, a turbine, and a rotor blade with which a small gap of a rotor cascade can be achieved.

DETAILED DESCRIPTION

Embodiments of the present invention will now be described in detail with reference to the accompanying drawings. It is intended, however, that unless particularly specified, dimensions, materials, shapes, relative positions, and the like of components described in the embodiments or illustrated in the accompanying drawings shall be interpreted as illustrative only and not limitative of the scope of the present invention.

For example, the expressions used herein that mean relative or absolute arrangement, such as "in a direction", "along a direction", "in parallel with", "orthogonal to", "center", "concentrically", and "coaxial" mean not only exactly what they refer to but also such states that are relatively displaced with a tolerance or by an angle or distance that is small enough to achieve the same level of functionality.

For example, the expressions used herein that mean things are equivalent to each other, such as "the same", "equivalent", and "uniform", mean not only exactly equivalent states but also such states that have a tolerance or a difference that is small enough to achieve the same level of functionality.

For example, expressions that represent shapes, such as quadrangles and cylindrical shapes, mean not only what they refer to in a geometrically strict sense but also shapes having some irregularities, chamfered portions, or the like that can provide the same level of functionality.

The expressions "including", "comprising", and "provided with" one component are not exclusive expressions that exclude other components.

Figure 1:
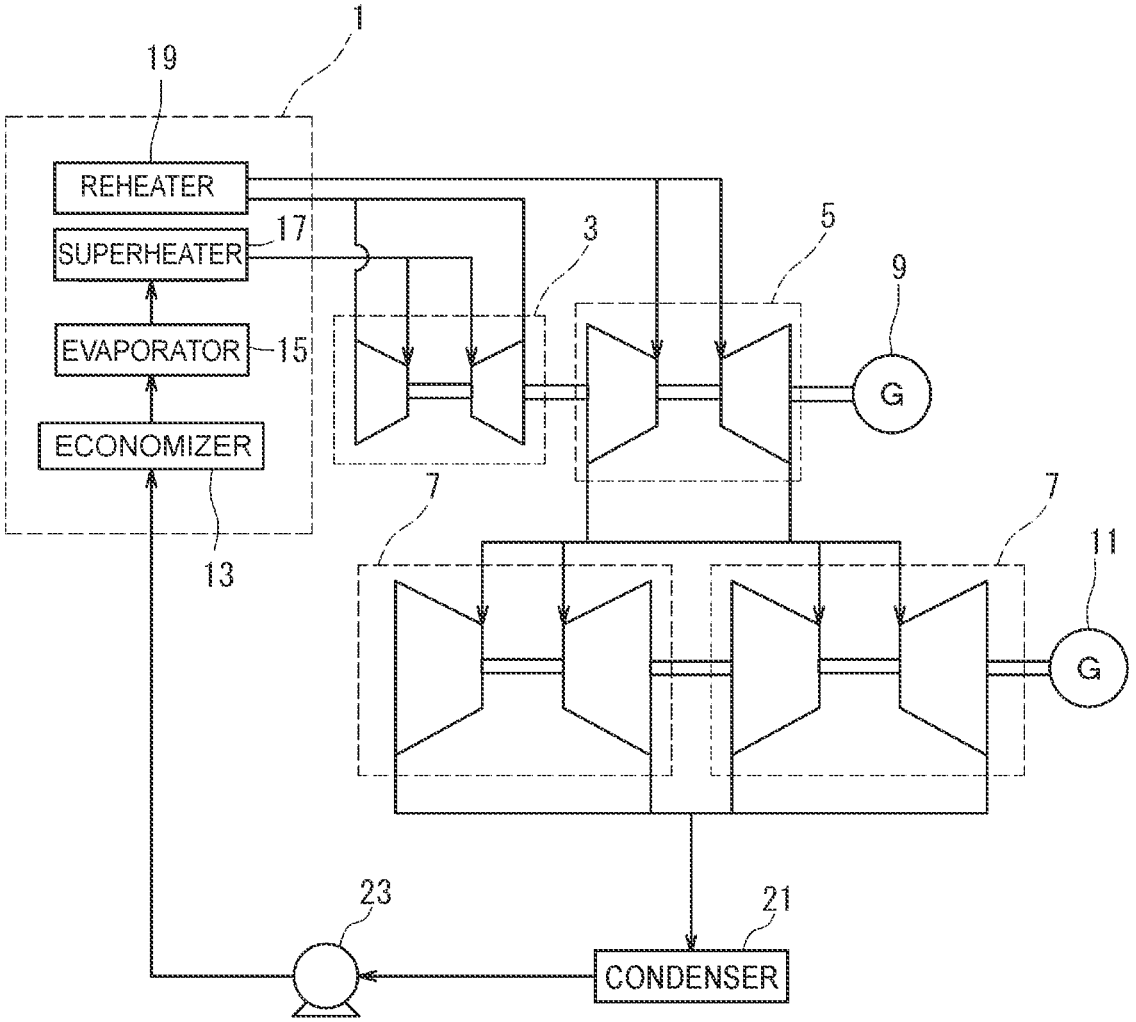
FIG. 1 is a block diagram schematically illustrating a configuration of a power generation system according to one embodiment of the present invention.

FIG. 1 is a block diagram schematically illustrating a configuration of a power generation system according to one embodiment of the present invention. For example, the power generation system is a thermal power generation system, and includes a boiler 1, a high-pressure turbine 3, a medium-pressure turbine 5, low-pressure turbines 7, and generators 9 and 11. For example, the power generation system has a cross-compound structure in which the high-pressure turbine 3 and the medium-pressure turbine 5 are coupled to the generator 9, and the two low-pressure turbines 7 are coupled to the generator 11.

In some embodiments, the power generation system has a tandem compound structure in which the high-pressure turbine 3, the medium-pressure turbine 5, and the low-pressure turbines 7 are connected to a single generator 9 via a single shaft.

In some embodiments, a part of or all of the high-pressure turbine 3, the medium-pressure turbine 5, and the low-pressure turbines 7 is a single flow turbine.

In some embodiments, the high-pressure turbine and the medium-pressure turbine are formed of a high-medium integrated turbine in which a high pressure section and a middle pressure section are accommodated in a single chamber, and the power generation system is formed by combining the low-pressure turbine with such a turbine. In some embodiments, the power generation system is formed with an ultra-high-pressure turbine further combined to the high-pressure turbine 3, the medium-pressure turbine 5, and the low-pressure turbines 7.

In some embodiments, the power generation system is a combined power generation system including a gas turbine. In some embodiments, the power generation is for household use, and in some embodiments, the power generation system is for commercial use.

The boiler 1 combusts coal as fuel for example, and steam is generated by using heat generated by the combustion.

For example, the boiler 1 includes an economizer 13, an evaporator 15, a superheater 17, and a reheater 19. Water is heated by the economizer 13, the evaporator 15, and the superheater 17, whereby superheated steam is obtained. The superheated steam is supplied to the high-pressure turbine 3. The steam supplied to the high-pressure turbine 3 returns to the boiler 1 after working in the high-pressure turbine 3, and then is supplied to the reheater 19. The reheater 19 heats the steam, and the steam thus heated is supplied to the medium-pressure turbine 5. Then, the steam is supplied to the low-pressure turbine 7 after working in the medium-pressure turbine 5. The steam having undergone working in the low-pressure turbine 7 is condensed in a condenser 21 and becomes water. The water thus obtained is supplied to the boiler 1 again by the condensate pump 23.

Figure 2:
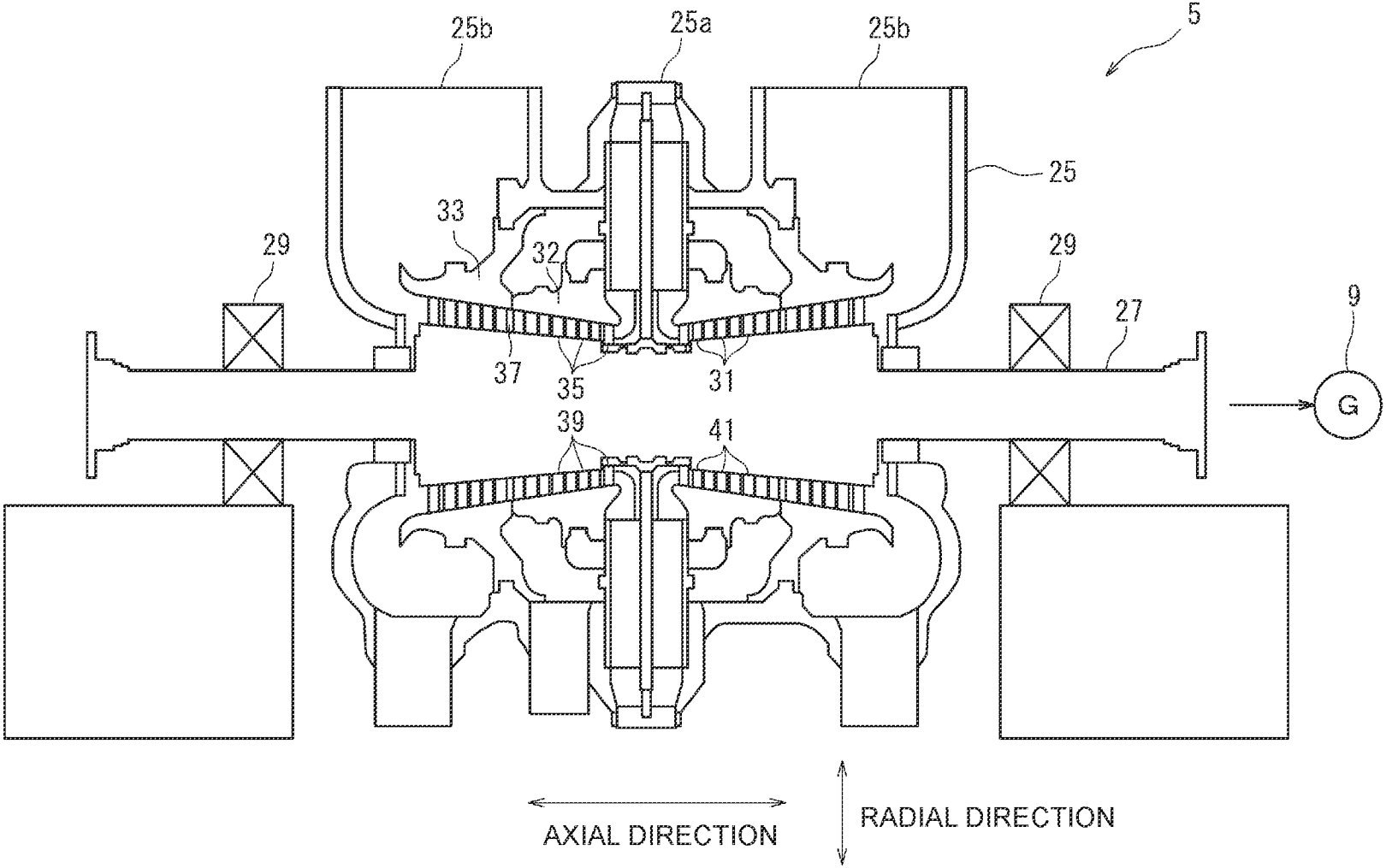
FIG. 2 is a vertical cross-sectional view illustrating a schematic configuration of a medium-pressure turbine.

FIG. 2 is a vertical cross-sectional view illustrating a schematic configuration of the medium-pressure turbine 5.

The medium-pressure turbine 5 illustrated in FIG. 2 includes a housing (chamber) 25 and a rotor shaft 27. The housing 25 surrounds an intermediate portion of the rotor shaft 27, and the rotor shaft 27 has both end portions rotatably supported by radial bearings 29.

The power generation system has a multi chamber structure with the high-pressure turbine 3, the medium-pressure turbine 5, and the low-pressure turbines 7 each having a housing independent from those of the other turbines. Alternatively, the power generation system may have a single chamber structure with the high-pressure turbine 3, the medium-pressure turbine 5, and the low-pressure turbines 7 having a common housing.

A plurality of rotor cascades 31 are fixed on the rotor shaft 27 while being separated from each other in the axial direction of the rotor shaft 27. A plurality of stator cascades 35 are fixed on the housing 25, while being separated from each other in the axial direction of the rotor shaft 27, via blade rings 32 and 33.

A cylindrical inner flow path 37 is formed between the blade rings 32 and 33 and the rotor shaft 27. The stator cascades 35 and the rotor cascades 31 are arranged on the inner flow path 37. The stator cascades 35 each include a plurality of stator blades 39 arranged along the circumferential direction of the rotor shaft 27. The stator blades 39 are fixed to the blade rings 32 and 33. The rotor cascades 31 each include a plurality of rotor blades (turbine rotor blades) 41 arranged along the circumferential direction of the rotor shaft 27. The rotor blades 41 are fixed to the rotor shaft 27. In each stator cascade 35, a flow of the steam is accelerated. In each rotor cascade 31, energy of the steam is converted into rotational energy for the rotor shaft 27.

The housing 25 has: a steam inlet 25*a* at the center in the axial direction of the rotor shaft 27; and two steam outlets 25*b* on both sides of the steam inlet 25*a*. The medium-pressure turbine 5 is a double flow turbine. Thus, the housing 25 incorporates two inner flow paths 37 extending toward opposite sides from the center in the axial direction of the rotor shaft 27.

Figure 3:
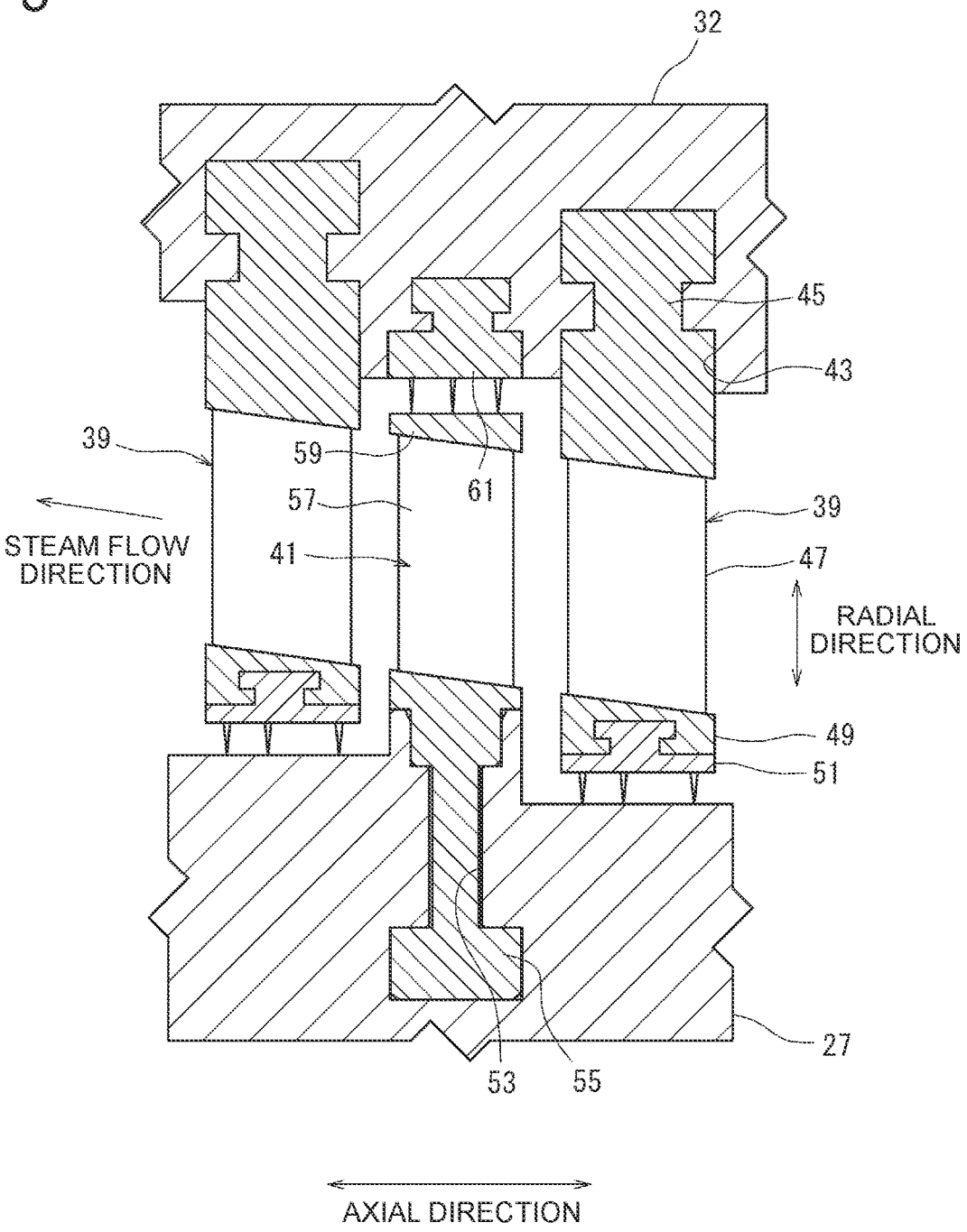
FIG. 3 is a partially enlarged view schematically illustrating a portion of FIG. 2 in an enlarged manner.

FIG. 3 schematically illustrates a portion of FIG. 2 in an enlarged manner. Specifically, FIG. 3 schematically illustrates a single rotor blade 41 disposed between two stator blades 39 in different stator cascades 35.

As illustrated in FIG. 3, the blade ring 32 includes a blade groove 43 extending along the circumferential direction of the rotor shaft 27. The stator blade 39 includes a blade root section 45, a blade profile section 47, and a shroud portion 49 that are integrally formed. The stator blade 39 is fixed to the blade ring 32, when the blade root section 45 is fit in the blade groove 43. A sealing member 51 is attached to the shroud portion 49 of the stator blade 39, and closes a gap between the shroud portion 49 and the rotor shaft 27.

As illustrated in FIG. 3, a blade groove 53 extending along the circumferential direction of the rotor shaft 27 is formed on the rotor shaft 27. The rotor blade 41 includes a blade root section 55, a blade profile section 57, and a shroud portion 59 integrally formed. The rotor blade 41 is fixed to the rotor shaft 27, when the blade root section 55 is fit to the blade groove 53. A sealing member 61 is attached to a portion of the blade ring 32 facing the shroud portion 59 of the rotor blade 41, and closes a gap between the shroud portion 59 and the blade ring 32.

In this specification, the rotor shaft 27 and the plurality of rotor blades 41 fixed to the rotor shaft 27 are collectively referred to as a turbine rotor assembly.

Figure 4:
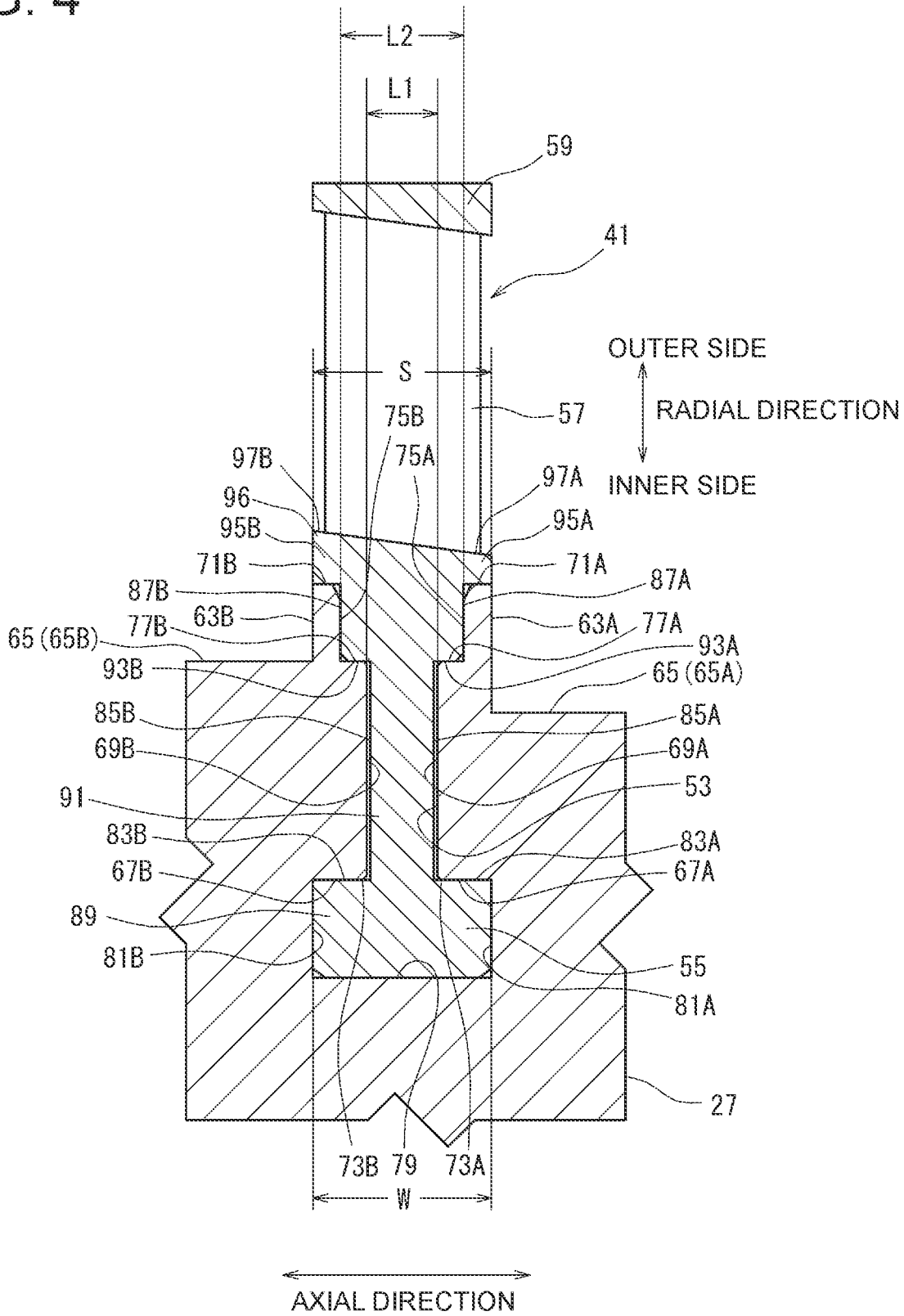
FIG. 4 is a diagram schematically illustrating a part of a rotor shaft and a rotor blade in FIG. 3.

FIG. 4 is an enlarged view of a part of the rotor shaft 27 and the rotor blade 41 in FIG. 3. A structure for attaching the rotor blades 41 to the rotor shaft 27 in the turbine rotor assembly in the turbine rotor assembly is described with reference to FIG. 4.

The rotor shaft 27 has two protrusion 63A and 63B for a single blade groove 53. The protrusions 63A and 63B each extend outward in the radial direction of the rotor shaft 27 from an outer circumferential surface 65 of each rotor shaft 27. A length, in the radial direction of the rotor shaft 27, from an axial center line of the rotor shaft 27 to the outer circumferential surface 71A of the protrusion 63A is equal to a length, in the radial direction of the rotor shaft, from the axial center line of the rotor shaft 27 to the outer circumferential surface 71B of the protrusion 63B. The protrusions 63A and 63B are separated from each other in the axial direction of the rotor shaft 27. The protrusions 63A and 63B form a part of the wall surface of the blade groove 53 and an opening of the blade groove 53.

The rotor shaft 27 includes two bearing surfaces 67A and 67B for a single blade groove 53. The two bearing surfaces 67A and 67B are each a cylindrical surface provided on the inner side of the outer circumferential surface 65 of the rotor shaft 27 in the radial direction of the rotor shaft 27, and face inward in the radial direction of the rotor shaft 27. The two bearing surfaces 67A and 67B are separated from each other in the axial direction of the rotor shaft 27, and form a part of the wall surface of the blade groove 53.

The rotor shaft 27 has two first facing surfaces 69A and 69B for a single blade groove 53. The two first facing surfaces 69A and 69B are disposed between the bearing surfaces 67A and 67B and the outer circumferential surfaces 71A and 71B of the protrusions 63A and 63B in the radial direction of the rotor shaft 27, and extend in the radial direction of the rotor shaft 27 from inner edges 73A and 73B of the bearing surfaces 67A and 67B. The two first facing surfaces 69A and 69B are annular surfaces facing each other in the axial direction of the rotor shaft 27, and form a part of the wall surface of the blade groove 53.

The rotor shaft 27 further includes two second facing surfaces 75A and 75B for a single blade groove 53. The two second facing surfaces 75A and 75B are positioned between the bearing surfaces 67A and 67B and the outer circumferential surfaces 71A and 71B of the protrusions 63A and 63B, in the radial direction of the rotor shaft 27 and are positioned on the outer sides of the two first facing surfaces 69A and 69B.

The second facing surfaces 75A and 75B also extend along the radial direction of the rotor shaft 27, and are annular surfaces facing each other in the axial direction of the rotor shaft 27. A gap L2 between the second facing surfaces 75A and 75B is larger than a gap L1 between the first facing surfaces 69A and 69B. Thus, the first facing surfaces 69A and 69B and the second facing surfaces 75A and 75B are connected to each other via step surfaces 77A and 77B. The step surfaces 77A and 77B are cylindrical surfaces facing outward in the radial direction of the rotor shaft 27. The second facing surfaces 75A and 75B and the step surfaces 77A and 77B also form a part of the wall surface of the blade groove 53.

The rotor shaft 27 further includes a bottom surface 79 forming a bottom of the blade groove 53. The bottom surface 79 is a cylindrical surface facing outward in the radial direction of the rotor shaft 27. Third facing surfaces 81A and 81B, standing from both edges of the bottom surface 79 in the axial direction of the rotor shaft 27, extend to outer edges of the bearing surfaces 67A and 67B. The third facing surfaces 81A and 81B are also annular surfaces extending along the radial direction of the rotor shaft 27 and facing each other in the axial direction of the rotor shaft 27.

The blade root section 55 of the rotor blade 41 has two contact surfaces 83A and 83B, two first side surfaces 85A and 85B, and two second side surfaces 87A and 87B.

The blade root section 55 includes a head portion 89 corresponding to a lateral bar of a T shape and a neck portion 91 corresponding to a longitudinal bar of the T shape. The two contact surfaces 83A and 83B form a part of a wall surface of a head portion 89. The two contact surfaces 83A and 83B each face outward in the radial direction of the rotor shaft 27, and are separated from each other in the axial direction of the rotor shaft 27 with the neck portion 91 provided therebetween. The two contact surfaces 83A and 83B are contactable with the two bearing surfaces 67A and 67B in the radial direction of the rotor shaft 27. The position of the rotor blade 41 in the radial direction of the rotor shaft 27 is determined by the bearing surfaces 67A and 67B.

The two first side surfaces 85A and 85B form a part of a wall surface of the neck portion 91, and face outward in the axial direction of the rotor shaft 27. The two first side surfaces 85A and 85B respectively face the two first facing surfaces 69A and 69B with a gap therebetween.

The two second side surfaces 87A and 87B also form a part of the wall surface of the neck portion 91 and face outward in the axial direction of the rotor shaft 27. The two second side surfaces 87A and 87B respectively face the two second facing surfaces 75A and 75B with a gap therebetween. This gap is smaller than that between the first facing surfaces 69A and 69B and the first side surfaces 85A and 85B.

The first side surfaces 85A and 85B and the second side surfaces 87A and 87B are fan shaped surfaces in parallel with the radial direction of the rotor shaft 27. The second side surfaces 87A and 87B are positioned on the outer sides of the first side surfaces 85A and 85B in the radial direction of the rotor shaft 27. The first side surfaces 85A and 85B and the second side surfaces 87A and 87B are connected to each other through cylindrical step surfaces 93A and 93B facing inward in the radial direction of the rotor shaft 27.

The neck portion 91 of the blade root section 55 has the flange sections 95A and 95B on a side of the blade profile section 57. The flange sections 95A and 95B are positioned adjacent to the outer circumferential surfaces 71A and 71B of the two protrusions 63A and 63B in the radial direction of the rotor shaft 27, and form a part of the platform section 96 that supports the blade profile section 57.

In this configuration, the rotor blade 41 includes the first side surfaces 85A and 85B and the second side surfaces 87A and 87B. The rotor shaft 27 has a corresponding structure with the first facing surfaces 69A and 69B and the second facing surfaces 75A and 75B forming a part of the wall surface of the blade groove 53. The gap L1 between the first facing surfaces 69A and 69B is smaller than the gap L2 between the second facing surfaces 75A and 75B. A contact area between the contact surfaces 83A and 83B of the blade root section 55 and the bearing surfaces 67A and 67B of the rotor shaft 27 can be increased in accordance with the difference between the gaps L1 and L2. Thus, the head portion 89 of the blade root section 55 can have a short length in the axial direction of the rotor shaft 27, whereby a small interval of the rotor cascades 31 can be achieved.

All things considered, the medium-pressure turbine 5 using the turbine rotor assembly can have the number of stages increased without having an increased size, or can have a smaller size with the number of stages maintained.

In this configuration, the protrusions 63A and 63B protrude from the outer circumferential surface 65 of the rotor shaft 27. Thus, the blade root section 55 of the rotor blade 41 has a small exposed area, whereby an exposed area of the gap between the blade root sections 55 of the rotor blades 41 adjacent to each other in the circumferential direction of the rotor shaft 27 can be reduced. Thus, the efficiency of the medium-pressure turbine 5 can be improved with a leakage flow of the working fluid reduced.

In this configuration, the two flange sections 95A and 95B are provided on the side of the blade profile section 57 of the blade root section 55, and form a part of the platform section 96. Thus, the blade profile section 57 can be supported by a large platform section 96.

The platform section 96 has a part disposed on the outer side of the protrusions 63A and 63B in the radial direction of the rotor shaft 27. The length of the turbine stage needs not to be set large in accordance with the width of the protrusions 63A and 63B (length in the axial direction of the rotor shaft 27). Alternatively, the platform section 96 (and thus the blade profile section 57) needs not to be set small, when the length of the turbine stage is maintained.

Furthermore, in this configuration, the second side surfaces 87A and 87B contact the second facing surfaces 75A and 75B when the vibration of the rotor blade 41 increases while the medium-pressure turbine 5 is operating, whereby the amplitude of the vibration can be prevented from increasing.

In this configuration, the blade root section 55 is stably restricted only by the bearing surfaces 67A and 67B as long as the amplitude of the vibration does not increase. Thus, a stable amplitude of the rotor blade 41 can be achieved while the medium-pressure turbine 5 is operating.

In some embodiments, the rotor blade 41 can be fixed to the blade groove 53 with the movement of the rotor shaft 27 of the rotor blade 41 in the axial direction and the rotation (twisting) of the rotor blade 41 in the blade groove 53 restricted, by setting the gap between second facing surfaces 75A and 75B of the rotor shaft 27 and the second side surfaces 87A and 87B of the blade root section 55 (the gap between the facing surfaces) to be a minimum possible gap required for the rotor blade 41 to be embedded in the blade groove 53 formed on the rotor shaft 27 in the circumferential direction.

The turbine rotor assembly according to the embodiments described above is not limited to the medium-pressure turbine 5, and can be applied to the high-pressure turbine 3 and to the low-pressure turbine 7.

In some embodiments, a length W, in the axial direction of the rotor shaft 27, of the head portion 89 of the blade root section 55 is 1.2 times a length S of the platform section 96 or less. In this configuration with the length W, in the axial direction of the rotor shaft 27, of the head portion 89 of the blade root section 55 being 1.2 times the length S of the platform section 96 or less, the small interval of the rotor cascades 31 can be guaranteed.

In some embodiments, the length W, in the axial direction of the rotor shaft 27, of the head portion 89 of the blade root section 55 is not larger than the length S of the platform section 96. In this configuration with the length W, in the axial direction of the rotor shaft 27, of the head portion 89 of the blade root section 55 being not larger than the length S of the platform section 96, the small interval of the rotor cascades 31 can be guaranteed.

In some embodiments, the length W, in the axial direction of the rotor shaft 27, of the head portion 89 of the blade root section 55 is 0.7 times the length S of the platform section 96 or more.

In some embodiments, the two protrusions 63A and 63B include: the first protrusion 63A positioned on one side of the opening of the blade groove 53 in the axial direction of the rotor shaft 27; and the second protrusion 63B positioned on the other side of the opening of the blade groove 53.

The blade root section 55 of the rotor blade 41 includes: the first flange section 95A disposed adjacent to the outer circumferential surface 71A of the first protrusion 63A in the radial direction of the rotor shaft 27; and the second flange section 95B disposed adjacent to the outer circumferential surface 71B of the second protrusion 63B in the radial direction of the rotor shaft 27. The length of the first flange section 95A is shorter than a length of the first protrusion 63A (the length between the outer circumferential surface 65A of the rotor shaft 27 and the outer circumferential surface 71A of the first protrusion 63A) in the radial direction of the rotor shaft 27.

In a configuration where the plurality of rotor blades 41 are arranged along the circumferential direction of the rotor shaft 27, when there is a gap between the first flange sections 95A in the circumferential direction, the working fluid flows through the gap. Thus, the efficiency of the medium-pressure turbine 5 is degraded. In this regard, when the length, in the radial direction of the rotor shaft 27, of the first flange section 95A on the upstream side in the steam flow direction is shorter than the first protrusion 63A, the gap between the first flange sections 95A can be made smaller, whereby the leakage flow of the working fluid can be reduced.

As a result, the medium-pressure turbine 5 using the turbine rotor assembly can have a higher efficiency.

In some embodiments, the blade root section 55 of the rotor blade 41 includes: the first flange section 95A disposed adjacent to the outer circumferential surface 71A of the first protrusion 63A in the radial direction of the rotor shaft 27; and the second flange section 95B disposed adjacent to the outer circumferential surface 71B of the second protrusion 63B in the radial direction of the rotor shaft 27. The length of the second flange section 95B is shorter than the length of the second protrusion 63B (the length between the outer circumferential surface 65B of the rotor shaft 27 and the outer circumferential surface 71B of the second protrusion 63B) in the radial direction of the rotor shaft 27.

In some embodiments, the rotor shaft 27 on the upstream side in the steam flow direction has an outer diameter at the outer circumferential surface 65A that is equal to or smaller than an outer diameter of the rotor shaft 27 on the downstream side in the steam flow direction at the outer circumferential surface 65B.

In some embodiments, the first flange section 95A and the second flange section 95B respectively include outer surfaces 97A and 97B facing outward in the radial direction of the rotor shaft 27. The outer surface 97A of the first flange section 95A and the outer surface 97B of the second flange section 95B form a part of a tapered surface inclined with respect to the axial direction of the rotor shaft 27. In some embodiment, the inclined tapered surface is rounded or chamfered.

When the rotor blade 41 is a reaction blade, the inner flow path 37 around the rotor shaft 27 gradually increases from the upstream side toward the downstream side. In the configuration described above, the outer surfaces 97A and 97B of the first flange section 95A and the second flange section 95B form a tapered surface, whereby the inner flow path 37 for the working fluid that gradually increases can be achieved with a simple configuration.

When the rotor blade 41 is a reaction blade, the number of stages is likely to be larger than that in a case of an impulse blade. In the configuration described above, the interval of the rotor cascades 31 in the axial direction of the rotor shaft 27 can be made small, and thus the size of the medium-pressure turbine 5 can be prevented from increasing even when there is a large number of stages.

In some embodiments, the outer surface 97A of the first flange section 95A and/or the outer surface 97B of the second flange section 95B is in parallel with the axial direction of the rotor shaft 27. In some embodiment, the surface in parallel with the axial direction is rounded or chamfered.

In some embodiments, the outer surface 97A of the first flange section 95A and/or the outer surface 97B of the second flange section 95B has a cross section at least partially being a simple arch shape or contour shape (multiple arcs and spline).

The outer surfaces 97A and 97B of the flange sections 95A and 95B may each have a shape that is in parallel with the axial direction of the rotor shaft 27. Furthermore, one of the outer surfaces 97A and 97B may be in parallel with the axis of the rotor shaft 27, while the other one is inclined. Furthermore, the outer surfaces 97A and 97B may each have a cross-sectional shape having at least a part formed by combing a simple arc shape and contour shape. Thus, a flow path of a desired shape can be formed.

In some embodiments, the rotor shaft 27 has a drum shape.

Generally, when the rotor shaft 27 has a drum shape, the rotor blade 41 is a reaction blade. When the rotor blade 41 is a reaction blade, the number of stages is likely to be larger than that in a case of an impulse blade. In the configuration described above, the interval of the rotor cascades 31 in the axial direction of the rotor shaft 27 can be made small, and thus the size of the medium-pressure turbine 5 can be prevented from increasing even when there is a large number of stages.

In some embodiments, the blade groove 53 is perforated toward the outer circumferential surface 65 of the rotor shaft 27 toward the inner side by using a cutting tool. The blade groove 53 has a T-shaped circumferential cross section. The rotor blade 41 has the blade root section 55 fit to the blade groove 53 in the circumferential direction or in a tangential direction. The blade root section 55 has a T shape.

More specifically, the rotor shaft 27 includes: a rotor-shaft outer circumferential surface side perforated surface extending in the radial direction of the rotor shaft 27; and a rotor-shaft outer circumferential surface side perforated surface extending in the axial direction of the rotor shaft 27. The rotor-shaft outer circumferential surface side perforated surface and the rotor-shaft outer circumferential surface side perforated surface define the blade groove 53. The rotor-shaft outer circumferential surface side perforated surface is the first facing surfaces 69A and 69B, and the rotor-shaft outer circumferential surface side perforated surface is the bearing surfaces 67A and 67B. The protrusions 63A and 63B protrude from the outer circumferential surface 65 of the rotor shaft 27 in the radial direction of the rotor shaft 27. The protrusions 63A and 63B include rotor-shaft radial direction inner side annular surfaces separated from each other in the axial direction of the rotor shaft 27; and rotor-shaft radial top outer circumferential surfaces positioned on the outer side in the radial direction of the rotor shaft 27. The rotor-shaft radial direction inner side annular surfaces are the second facing surfaces 75A and 75B. The rotor-shaft radial top outer circumferential surfaces are the outer circumferential surfaces 71A and 71B.

The rotor blade 41 includes: the first side surfaces 85A and 85B facing the rotor-shaft outer circumferential surface side perforated surfaces; the contact surfaces 83A and 83B contactable with the rotor-shaft outer circumferential surface side perforated surfaces; the second side surfaces 87A and 87B facing the rotor-shaft radial direction inner side annular surfaces; and jaw portions form the platform section 96 of the rotor blade 41 and are positioned adjacent to the rotor-shaft radial top outer circumferential surface. The jaw portions are the flange sections 95A and 95B.

The present invention is not limited to the embodiment described above, and includes a mode obtained by modifying the embodiment described above and modes obtained by appropriately combining these modes.

For example, the radial direction length of the rotor shaft between the axial center line of the rotor shaft 27 and the outer circumferential surface 71A of the protrusion 63A may be different from the radial direction length of the rotor shaft between the axial center line of the rotor shaft 27 and the outer circumferential surface 71B of the protrusion 63B.

The length between the outer circumferential surface 65A of the rotor shaft 27 and the outer circumferential surface 71A of the first protrusion 63A in the radial direction of the rotor shaft 27 may be the same as, longer than, or shorter than the length between the outer circumferential surface 65B of the rotor shaft 27 and the outer circumferential surface 71B of the second protrusion 63B.

REFERENCE SIGNS LIST

1 Boiler
3 High-pressure turbine
5 Medium-pressure turbine
7 Low-pressure turbine
9, 11 Generator
13 Economizer
15 Evaporator
17 Superheater
19 Reheater
21 Condenser
23 Condensate pump
25 Housing (chamber)
25*a* Steam inlet
25*b* Steam outlet
27 Rotor shaft
29 Radial bearing
31 Rotor cascade
32, 33 Blade ring
35 Stator cascade
37 Inner flow path
39 Stator blade
41 Rotor blade
43 Blade groove
45 Blade root section
47 Blade profile section
49 Shroud portion
51 Sealing member
53 Blade groove
55 Blade root section
57 Blade profile section
59 Shroud portion
61 Sealing member
63A Protrusion (first protrusion)
63B Protrusion (second protrusion)
65 (65A, 65B) Outer circumferential surface
67A, 67B Bearing surface
69A, 69B First facing surface
71A, 71B Outer circumferential surface
73A, 73B Inner edge
75A, 75B Second facing surface
77A, 77B Step surface
79 Bottom surface
81A, 81B Third facing surface
83A, 83B Contact surface
85A, 85B First side surface
87A, 87B Second side surface
89 Head portion
91 Neck portion
93A, 93B Step surface
95A First flange section
95B Second flange section
96 Platform section
97A, 97B Outer surface

The invention claimed is:

1. A turbine rotor assembly comprising:

a rotor shaft on which a blade groove extending along a circumferential direction is defined; and a rotor blade, the rotor blade including:

a blade section on an outer side of the rotor shaft in a radial direction of the rotor shaft; and a blade root section integrally formed with the blade section and configured to be fitted in the blade groove, wherein the rotor shaft includes:

two protrusions which are separated from each other in an axial direction of the rotor shaft and define a first part of a wall surface of the blade groove and an opening of the blade groove, the two protrusions each protruding outward from an outer circumferential surface of the rotor shaft in the radial direction of the rotor shaft;

two bearing surfaces on an inner side of the outer circumferential surface of the rotor shaft in the radial direction of the rotor shaft, the two bearing surfaces facing inward in the radial direction of the rotor shaft, the two bearing surfaces being separated from each other in the axial direction of the rotor shaft and the two bearing surfaces defining a second part of the wall surface of the blade groove;

two first facing surfaces which face each other in the axial direction of the rotor shaft and define a third part of the wall surface of the blade groove, the two first facing surfaces being between the two bearing surfaces and outer circumferential surfaces of the two protrusions in the radial direction of the rotor shaft; and two second facing surfaces between the two bearing surfaces and the outer circumferential surfaces of the two protrusions in the radial direction of the rotor shaft, on an outer side of the two first facing surfaces, the two second facing surfaces facing each other in the axial direction of the rotor shaft with a gap therebetween which is larger than a gap between the first facing surfaces, the two second facing surfaces defining a fourth part of the wall surface of the blade groove, and wherein the blade root section includes:

two contact surfaces which are separated from each other in the axial direction of the rotor shaft, and are contactable with the two bearing surfaces in the radial direction of the rotor shaft, respectively;

two first side surfaces each facing a corresponding one of the two first facing surfaces;

two second side surfaces each facing a corresponding one of the two second facing surfaces with a gap therebetween that is smaller than a distance between a corresponding one of the two first facing surfaces and a corresponding one of the two first side surfaces facing the corresponding one of the two first facing surfaces; and two flange sections which are each positioned, when the blade root section is fitted in the blade groove, adjacent to the outer circumferential surface of a corresponding one of the two protrusions in the radial direction of the rotor shaft, the two flange sections defining a part of a platform section continuing to a blade profile section of the rotor blade.

2. The turbine rotor assembly according to claim 1, wherein a length, in the axial direction of the rotor shaft, of the blade root section including the two contact surfaces, at a position where the two contact surfaces are defined, is 1.2 times a length of the platform section or less.

3. The turbine rotor assembly according to claim 2, wherein the length, in the axial direction of the rotor shaft, of the blade root section including the two contact surfaces, at the position where the two contact surfaces are defined, is not longer than the length of the platform section.

4. The turbine rotor assembly according to claim 1, wherein:

the two protrusions include:

a first protrusion on an upstream side in a flow direction of a working fluid; and a second protrusion on a downstream side in the flow direction of the working fluid, a first of the two flange sections is adjacent to the outer circumferential surface of the first protrusion in the radial direction of the rotor shaft; and a second of the two flange sections is adjacent to the outer circumferential surface of the second protrusion in the radial direction of the rotor shaft, and a length of at least the first of the two flange sections is shorter than a length between the outer circumferential surface of the rotor shaft and the outer circumferential surface of the first protrusion, in the radial direction of the rotor shaft.

5. The turbine rotor assembly according to claim 1, wherein the rotor shaft has a drum shape.

6. A turbine comprising:

the turbine rotor assembly according to claim 1;

a housing enclosing the turbine rotor assembly; and a stator blade attached to the housing.

7. The turbine rotor assembly according to claim 1, wherein a length, in the axial direction of the rotor shaft, of the blade root section including the two contact surfaces, at a position where the two contact surfaces are defined, is 0.7 times a length of the platform section or more.

8. The turbine rotor assembly according to claim 1, wherein each of the two bearing surfaces is planar.

9. The turbine rotor assembly according to claim 1, wherein each of the two contact surfaces is planar.

10. The turbine rotor assembly according to claim 1, wherein:

each of the two bearing surfaces is planar; and each of the two contact surfaces is planar.

11. The turbine rotor assembly according to claim 1, wherein:

each of the two bearing surfaces is planar;

each of the two first facing surfaces is planar;

each of the two second surfaces is planar;

each of the two contact surfaces is planar;

each of the two first side surfaces is planar; and each of the two second side surfaces is planar.

12. The turbine rotor assembly according to claim 1, wherein the rotor blade is one of a plurality of rotor blades.

13. The turbine according to claim 6, wherein the stator blade is one of a plurality of stator blades.

14. The turbine according to claim 6, wherein:

the rotor blade is one of a plurality of rotor blades; and the stator blade is one of a plurality of stator blades.

* * * * *